United States Patent [19]

Ambo

[11] Patent Number: 4,899,801

[45] Date of Patent: Feb. 13, 1990

[54] METHOD FOR CONTINUOUS CASTING OF METAL AND AN APPARATUS THEREFOR

[75] Inventor: Yoshikatsu Ambo, Saitama, Japan

[73] Assignee: Asaba Co., Ltd., Tokyo, Japan

[21] Appl. No.: 293,552

[22] Filed: Jan. 3, 1989

Related U.S. Application Data

[63] Continuation of Ser. No. 55,307, May 29, 1987, abandoned.

[30] Foreign Application Priority Data

Jun. 10, 1986 [JP] Japan ..... 61-134547

[51] Int. Cl.[4] ..... B22D 27/04

[52] U.S. Cl. ..... 164/122.1; 164/485; 164/488

[58] Field of Search ..... 164/122, 122.1, 122.2, 164/443, 444, 438, 439, 485, 486, 487, 488, 489

[56] References Cited

U.S. PATENT DOCUMENTS

| | | | |
|---|---|---|---|
| 2,740,177 | 4/1956 | Smart, Jr. | 164/439 X |
| 3,598,174 | 8/1971 | Piesche | 164/439 X |

FOREIGN PATENT DOCUMENTS

| | | | |
|---|---|---|---|
| 2114505 | 10/1971 | Fed. Rep. of Germany | 164/443 |
| 61-169139 | 7/1986 | Japan | 164/122.1 |
| 61-169149 | 7/1986 | Japan | 164/122.1 |
| 61-193743 | 8/1986 | Japan | 164/122.1 |

*Primary Examiner*—Kuang Y. Lin

*Attorney, Agent, or Firm*—Hopgood, Calimafde, Kalil, Blaustein & Judlowe

[57] ABSTRACT

In the apparatus for continuous casting of a metal by drawing a solidified bar ingot through a tubular casting mold connected to an opening at the bottom of a crucible containing the melt, the tubular casting mold is protruded into the crucible in a substantial length and the cooling efficiency of the tubular casting mold and the drawing velocity of the solidified bar ingot are controlled to balance in such a manner that the temperature of the melt inside the tubular casting mold in the portion protruded into the crucible is substanially lower than the temperature of the bulk of melt to start solidification of the melt within the portion. When a bar ingot is prepared by using the apparatus and according to the method, great improvements can be obtained in the surface smoothness of the bar ingot and the metallographic structure of the same mainly composed of axially running columnar crystals.

3 Claims, 2 Drawing Sheets

METHOD FOR CONTINUOUS CASTING OF METAL AND AN APPARATUS THEREFOR

This application is a continuation of application Ser. No. 055,307, filed May 29, 1987, now abandoned.

BACKGROUND OF THE INVENTION

The present invention relates to a method for continuous casting of a metal as well as an apparatus therefor. More particularly, the invention relates to an improved method and apparatus for continuous casting of a metal capable of giving a continuouslength bar ingot of the metal having a unidirectionally solidified metallographic structure free from defects and segregation of impurities as well as smooth surface.

Along with the rapid progress of high technologies in recent years, the demand for a further and further improved quality of metallic materials is also increasing year by year. Such a demand has no exception for a ontinous-length bar material of metal ingot prepared by a process of continuous casting. Notwithstanding the increasing demand for upgrading, the products prepared by a conventional process of continuous casting have several problems and defects unless or even when a special means is added to the apparatus for the continuous casting. For example, the solidification of the molten metal in the conventional process of continuous casting always starts at the inner wall surface of the tubular casting mold and the growth of the solidified crust proceeds toward the center axis so that the solidified body is composed of a large number of cubic crystals and the structure thereof can rarely be formed of single crystals. Moreover, the bar ingot sometimes contains a large number of blowholes or the surface of the bar ingot is sometimes roughened due to the friction between the moving bar ingot and the inner walls of the tubular casting mold.

An improved method and apparatus for continuous casting of a metal are disclosed in Japanese Patent Publication 55-46265. The improvement disclosed there may provide the most promising way among the many proposals and attempts hitherto made, all of which, however, could give no fundamental solution of the problems. In this method and the apparatus used therefor, the temperature of the inner surface of the tubular casting mold at the exit is kept higher than the solidification temperature of the melt of the metal under casting. This method, therefore, involves a danger of break-out and can be performed only under very troublesome control of various operating conditions since no solidified crust can be formed inside the casting mold and a solidified crust is first formed only at a certain height below the exit out of the casting mold.

SUMMARY OF THE INVENTION

The present invention therefore has an object to provide an improved method and an apparatus for continuous casting of a metal free from the above described problems and disadvantages in the prior art.

The apparatus of the present invention for continuous casting of a metal into a continuous-length bar ingot comprises:

(a) a crucible made of a refractory material for containing a melt of a metal and having an opening at the bottom;

(b) a tubular casting mold made of a refractory material, which is held in an upright disposition and tightly inserted into the opening at the bottom of the crucible to such a height that the upper end portion of the mold is protruded into the crucible in a length of at least 20 mm above the bottom of the crucible; and (c) a means for cooling the tubular casting mold provided at a height below the opening at the bottom of the crucible.

The cooling means of the tubular casting mold should be efficient enough so that, when the process of continuous casting is running, the temperature of the melt inside the tubular casting mold in a portion protruded into the crucible is substantially lower than the temperature of the bulk of the molten metal contained in the crucible so that the solidification front of the melt is inside the tubular casting mold in a portion protruded into the crucible.

Accordingly, the method of the present invention provides an improvement, in a process of continuous casting of a metal by drawing a solidified bar ingot of the metal through a tubular casting mold vertically held and tightly connected to an opening at the bottom of a crucible containing a melt of the metal, which comprises:

(i) protruding the upper end portion of the tubular casting mold into inside of the crucible in a length of at least 20 mm immersed in the melt of the metal contained in the crucible;

(ii) cooling the tubular casting mold at a portion below the opening at the bottom of the crucible; and (iii) drawing the solidified bar ingot of the metal out of the lower exit end of the tubular casting mold at such a rate that the melt of the metal inside the tubular casting mold in the portion protruded into the crucible is kept at a temperature substantially lower than the temperature of the bulk of the melt in the crucible into which the tubular casting mold is protruded and the solidification front of the melt is inside the tubular casting mold in the portion protruded into the crucible by the balance of the cooling efficiency and the drawing rate.

DETAILED DESCRIPTION OF THE PREFERRED EMBODIMENTS

As is described in the above given summary of the invention, the essential features of the inventive apparatus consist in the tubular casting mold which should be protruded into the crucible in a substantial length from the bottom of the crucible so that the protruded portion of the tubular casting mold should be immersed in the melt of the metal during the process of continuous casting and the cooling means provided on the tubular casting mold at a height below the crucible, which cooling means should be so efficient that the melt of the metal inside the tubular casting mold in the portion protruded into the crucible should be kept at a temperature substantially lower than the temperature of the bulk of the melt in the crucible.

In the following, the apparatus of the invention and the method of continuous casting using the inventive apparatus are described in detail with reference to the accompanying drawing.

Figure 1:
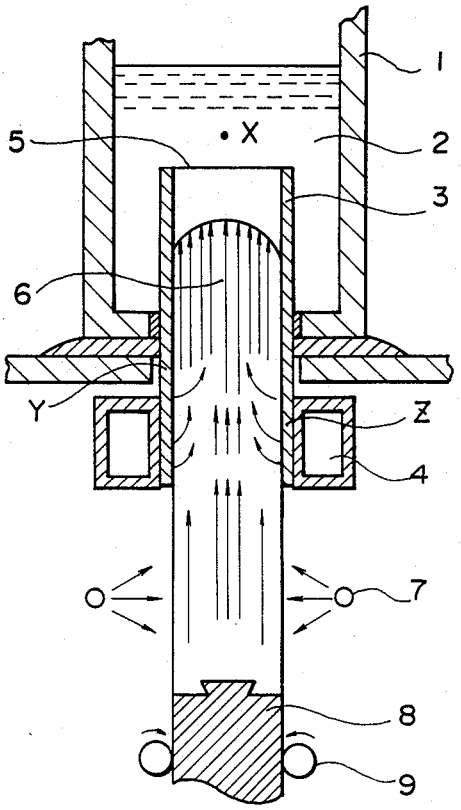
FIG. 1 is a schematic illustration of a vertical axial cross section of the inventive apparatus and FIG. 2 is a schematic illustration of an axial cross section of a continuous-length bar ingot prepared by the inventive method using the inventive apparatus showing the metallographic structure.

As is illustrated in FIG. 1, the crucible 1 made of a refractory material such as carbon is filled with a melt of metal 2. The tubular casting mold 3, which is also made of a refractory material, is vertically held and protruded in a certain length penetrating the bottom of the crucible 1 to have the upper opening 5 immersed in the melt 2. The length of the protruded portion of the tubular casting mold 3 naturally depends on the cross sectional dimensions of the tubular casting mold. It should usually be at least 20 mm when the diameter of the tubular casting mold is, for example, 10 mm or smaller. When the diameter of the mold is large, for example, in a range of 100 mm or larger, on the other hand, the length of protrusion should be between 100 and 200 mm although the exact length should be appropriately selected in consideration of various factors such as the material and wall thickness of the casting mold, kind of the metal under casting and others. Needless to say, the tubular casting mold 3 is tightly inserted into the crucible 1 or the joint is filled with a refractory cement so that no leak of the melt 2 in the crucible 1 can occur. The tubular casting mold 3 is surrounded by a jacket 4 to pass cooling water therethrough at a height below the bottom of the crucible 1 or rather below the bed on which the crucible 1 is mounted. The solidified ingot 6 of the metal in the tubular casting mold 3 is drawn down through the zone surrounded by the cooling jacket 4 and then through the zone surrounded by the spray nozzles 7 from which spray water is ejected to quench the bar ingot. The rate or velocity of drawing is controlled by means of the dummy bar 8 and a pair of pinch rollers 9.

At the start of the process of continuous casting, the melt 2 introduced into the tubular casting mold 3 from the upper opening 5 is cooled by the cooling water, in a similar manner to the conventional process, at the inner surface of the casting mold 3 forming a temperature gradient along the radial direction toward the center axis. The direction of temperature gradient inside the tubular casting mold 3 is gradually changed from such a radial direction to an upward direction shown by the arrows in the figure by ade-quately controlling the flow rate of the cooling water through the jacket 4 and/or the downward drawing velocity of the solidified bar ingot 6. Accordingly, the front of solidification, which has been initially at the height of the zone surrounded by the cooling jacket 4, gradually ascends in the tubular casting mold 3 to level off at a certain height below the upper opening 5 determined by the balance of the cooling efficiency and the velocity of drawing when a stationary state is established as is illustrated in the figure. It is essential in this case that the solidification front of the melt should be inside the tubular casting mold 3 in the portion protruded into the crucible 1. The temperature of the melt directly above the solidification front should preferably be lower than the bulk of the melt 2 in the crucible 1 by 10° to 30° C. or, preferably, by 15° to 20° C. Such a temperature difference can be readily established by measuring the temperatures of the melt in the bulk and on the solidification front by using thermocouples or other suitable means and making feed-back of the result of measurement to control the drawing velocity of the solidified bar ingot and the cooling efficiency such as the flow rate of the cooling water through the jacket 4.

Figure 2:
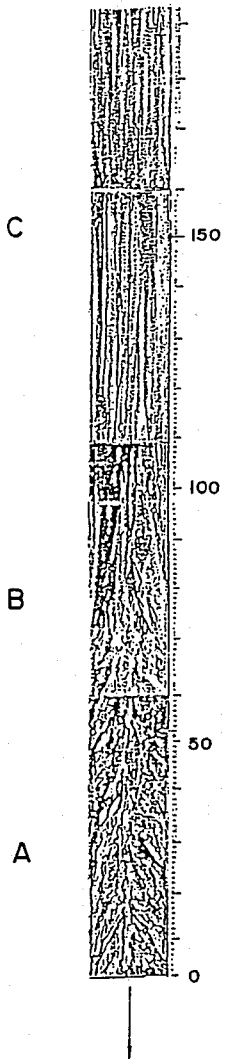

FIG. 2 schematically illustrates an axial cross section of a bar ingot obtained in the above described manner showing the metallographic structure. The lowest section A is formed at the starting period of the continuous casting process and mainly composed of the "cubic" crystals mixed with upwardly biased columnar crystals. The predominance of the columnar crystals gradually increases as the casting proceeds through the transient section B so that the section C formed in the stationary state is composed almost exclusively of the columnar crystals running in the axial direction although no clear demarcation is formed between the sections A, B and C.

It is important in the inventive method that the stationary state to form the axially columnar metallographic structure of the section C should be established as quickly as possible to minimize the mixed and transient sections A and B. In this regard, the cooling efficiency should be high enough by the combined use of the primary cooling with the cooling jacket 4 and the secondary cooling with the spray nozzles 7 so as to keep the melt 2 inside the tubular casting mold 3 just above the solidification front at a temperature, for example, by 15° to 20° C. lower than the bulk of the melt 2 in the crucible 1. Such a condition of temperature gradient is obtained by the balance of the cooling efficiency and the velocity of drawing as is mentioned above. It is of course that the cooling medium flowing through the jacket 4 is not limited to water but may be any other known cooling medium. The method and apparatus of the present invention are applicable to the continuous casting of any metal to which conventional continuous casting proceses are applicable without particular limitations.

The advantages obtained by the present invention include that: there is no danger of break-out since the incipiently solidified crust is formed while the melt is still in the upper portion of the tubular casting mold 3 protruded into the crucible 1; the apparatus is versatile and also can be used in a conventional process of continuous casting; the continuous-length bar ingot has a smooth surface so that the bar material can be used as such in many applications without further works of surface finishing; and the method is versatile to give bar ingots having various different cross sections which can be directly worked into fine wires, extremely thin foils and the like, so that the inventive method and apparatus are very useful for the industrial manufacture of many magnetic and semiconductor materials.

In the following, the apparatus and method of the invention for continuous casting of a metal are described in more detail by way of an example.

EXAMPLE

A continuous casting process of copper was undertaken by using an apparatus which was in principle the same as illustrated in FIG. 1. The carbon-made crucible 1 held in a furnace (not shown in the figure) to prevent cooling had an outer diameter of 390 mm, inner diameter of 330 mm and height of 600 mm. The carbon-made tubular casting mold 3 having an outer diameter of 190 mm, inner diameter of 150 mm and length of 400 mm was inserted into the crucible 1 through the opening at the bottom to such a height that a 100 mm long portion of the mold 3 was protruded into the crucible 1. A cooling jacket 4 made of a carbonaceous material was provided to surround the lower end portion of the tubular casting mold 3.

The crucible 1 was filled with a melt 2 of copper to start the process of continuous casting. The temperature of the melt 2 was in the range from 1100° to 1120° C. throughout the process as measured at the point indicated by the symbol X in the figure which was 50 mm above the center of the upper opening of the tubular casting mold 3. The drawing velocity of the solidified bar ingot was initially set at 200 mm/minute. The upper opening of the tubular casting mold 3 was 500 mm below the surface level of the melt 2 in the crucible 1. The temperature of the tubular casting mold 3 was about 900° C. and about 700° C. at points 80 mm and 115 mm below the bottom of the crucible indicated by the symbols Y and Z, respectively. The solidification front at this moment was about 150 mm below the bottom of the crucible 1. These conditions were about the same as in the conventional continuous casting process.

In the next place, the flow rate of the cooling water through the cooling jacket 4 was increased and the drawing velocity of the solidified bar ingot was decreased to 100 mm/minute so that the solidification front of the melt 2 in the tubular casting mold 3 was gradually moved upwardly to finally level off at a height of about the middle height of the 100 mm long portion of the tubular casting mold 3 protruded into the crucible 1 as is illustrated in the figure when a stationary state had been established. The temperature of the melt just above the solidification front was 1090° C. The temperature of the tubular casting mold 3 at the stationary state was 200° to 300° C. and about 150° C. at the points Y and Z, respectively. In this manner, the process of continuous casting was continued to give a continuous-length bar ingot of copper having a smooth surface and a metallographic structure of the axial cross section mainly composed of columnar crystals without segregation of impurities.

What is claimed is:

1. An improvement, in a process of continuous casting of a metal by drawing a solidified bar ingot of the metal through a tubular casting mold vertically held and tightly connected to an opening at the bottom of a crucible containing a melt of the metal, which comprises:

(i) protruding the upper end portion of the tubular casting mold into inside of the crucible in a substantial length in the melt of the metal;

(ii) cooling the tubular casting mold at a portion below the opening at the bottom of the crucible; and (iii) drawing the solidified bar ingot of the metal out of the lower exit end of the tubular casting mold at such a rate that the melt of the metal inside the tubular casting mold in the portion protruded into the crucible is kept at a temperature substantially lower than the temperature of the bulk of the melt in which the end portion of the tubular casting mold is immersed by the balance of the cooling efficiency and the drawing rate and a complete solidification of the melt of metal occurs inside the tubular casting mold in the portion protruded into the crucible with an upwardly convex profile at the solidification front.

2. The improvement as claimed in claim 1 wherein the tubular casting mold is protruded into the crucible in a length of at least 20 mm.

3. The improvement as claimed in claim 1 wherein the melt of metal inside the tubular casting mold in the portion protruded into the crucible is kept at a temperature by 10° to 30° C. lower than the temperature of the bulk of the melt in the crucible as measured at a point just above the solidification front.

* * * * *